US005117998A

United States Patent [19]

Handzel

[11] Patent Number: 5,117,998

[45] Date of Patent: Jun. 2, 1992

[54] UNIVERSAL FIVE GALLON WIPER PLATE ASSEMBLY

[75] Inventor: James J. Handzel, New Hope, Minn.

[73] Assignee: Graco Inc., Minneapolis, Minn.

[21] Appl. No.: 772,157

[22] Filed: Oct. 7, 1991

[51] Int. Cl.[5] ..... B67D 5/64

[52] U.S. Cl. ..... 220/93; 222/386; 222/390

[58] Field of Search ..... 220/93; 222/256, 260, 222/261, 386, 386.5, 389, 390

[56] References Cited

U.S. PATENT DOCUMENTS

| | | | |
|---|---|---|---|
| 1,828,188 | 10/1931 | Jackson et al. . | |
| 2,080,856 | 5/1937 | Thomas | 222/390 X |
| 2,121,972 | 6/1938 | Linton | 221/47.1 |
| 2,660,491 | 11/1953 | Sundholm | 222/386 X |
| 2,726,802 | 12/1955 | Jones | 226/125 |
| 2,744,664 | 5/1956 | Patterson | 222/326 |
| 2,768,661 | 10/1956 | Tyler | 222/386 X |
| 2,981,445 | 4/1961 | Russell | 222/259 |
| 2,997,215 | 8/1961 | Chinchole | 222/261 |
| 3,393,833 | 7/1968 | King | 222/29 |
| 3,412,903 | 11/1968 | Van Ripee, Jr. et al. | 222/146 |
| 3,501,063 | 4/1968 | Sundholm | 222/326 |
| 3,752,367 | 8/1973 | Sundholm | 222/256 |
| 4,209,105 | 6/1980 | Dominique | 220/93 |
| 4,552,090 | 11/1985 | Coleman | 220/93 X |
| 4,632,281 | 12/1986 | Wold | 222/389 |
| 4,741,462 | 5/1988 | Schneider, Jr. | 222/386 |
| 5,037,009 | 8/1991 | Shea | 220/93 X |

OTHER PUBLICATIONS

"Follower ass'Y. (5 Gallon Tapered or Straight Pail)," Operator's Manual #651810-X, Aro Corporation, One Aro Center, Bryan, Ohio 43506, Revised Jan. 3, 1986.

*Primary Examiner*—Steven M. Pollard

[57] ABSTRACT

The wiper plate is designed for ue with a variety of five gallon pails including both straight and tapered pails as well as with either cart applications or with rams. One unit allows a variety of pails to be utilized with the one device. Primary and secondary wipers provide continued contact with a tapered pail. For straight sided pails, a reversible tapered spacer provides varying wiper flexibility depending on whether the unit is going to be used with the ram or cart-mounted pail.

4 Claims, 3 Drawing Sheets

UNIVERSAL FIVE GALLON WIPER PLATE ASSEMBLY

BACKGROUND OF THE INVENTION

Various types of inductor plates have been used for allowing pumps to remove viscous material from pails, drums and barrels over the years. Such plates are typically fitted with some sort of seal which is truly only usable in one type of container and requires either seal replacement or a different inductor for different containers (even those of the same general type and size.)

For instance, in five gallon pails, there are varieties manufactured with both straight and tapered sides. The past prior art devices have been manufactured by any number of manufacturers including The Aro Corporation and Graco Inc., the Assignee of the instant invention. While the Aro product has utilized a dual wiper assembly for accommodating tapered pails, such is less than ideal when utilized in ram or cart applications for pumping out of straight sided pails.

Each combination of pail type (straight or tapered) and application (ram or cart mounted) requires its own specific wiper plate characteristics for optimum performance.

Most of these generally have a pump mounted on top of the inductor plate. Cart mounted units merely utilize the weight of the inductor plate and the pump to press the plate downward into the material and insure feeding of the pump. In addition, a vacuum is created inside the pail as material is drawn into the pump which further assists in drawing the pump and wiper plate downward.

For extremely viscous material such as higher viscosity mastics, silicones and sealants, a so-called ram unit typically utilizes an externally applied force to force the pump and inductor plate downwardly into the container thereby increasing pressures in the pail and insuring proper loading of the pump.

It is therefore an object of this invention to provide a wiper plate assembly which is suitable for varying types of pails including the aforementioned straight and tapered pails in both cart and ram configurations. It is further an object of this invention to provide a wiper plate assembly which may be easily adjusted to accommodate the varying desired configurations.

SUMMARY OF THE INVENTION

A wiper plate assembly has a central wiper plate which has a circular portion, a cylindrical portion and a lip portion. A main wiper is attached to the bottom of the wiper plate circular portion such that part of the main wiper, the cylindrical portion and the lip portion form a U-shaped annular channel which contains a spacer which is trapezoidal in cross section and forms a tapered hollow cylinder.

When used in a ram application with straight sided pails, a stiff sealing mechanism is required and the spacer is arranged in the channel such that the larger diameter is facing downwardly against the main wiper thereby limiting deflection and providing a stiffer backup for that wiper.

When it is desired to utilize the mechanism in a cart mounted application with straight sided pails, the spacer is reversed such that the smaller diameter faces downward thereby allowing the main wiper to flex more easily due to the limited downward force applied to it.

When it is configured to use with a tapered pail, the spacer is removed completely thereby allowing the main wiper to flex freely as the pail tapers during downward movement. A secondary wiper is provided beneath the main wiper to allow continued contact in sealing as the assembly moves downwardly.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
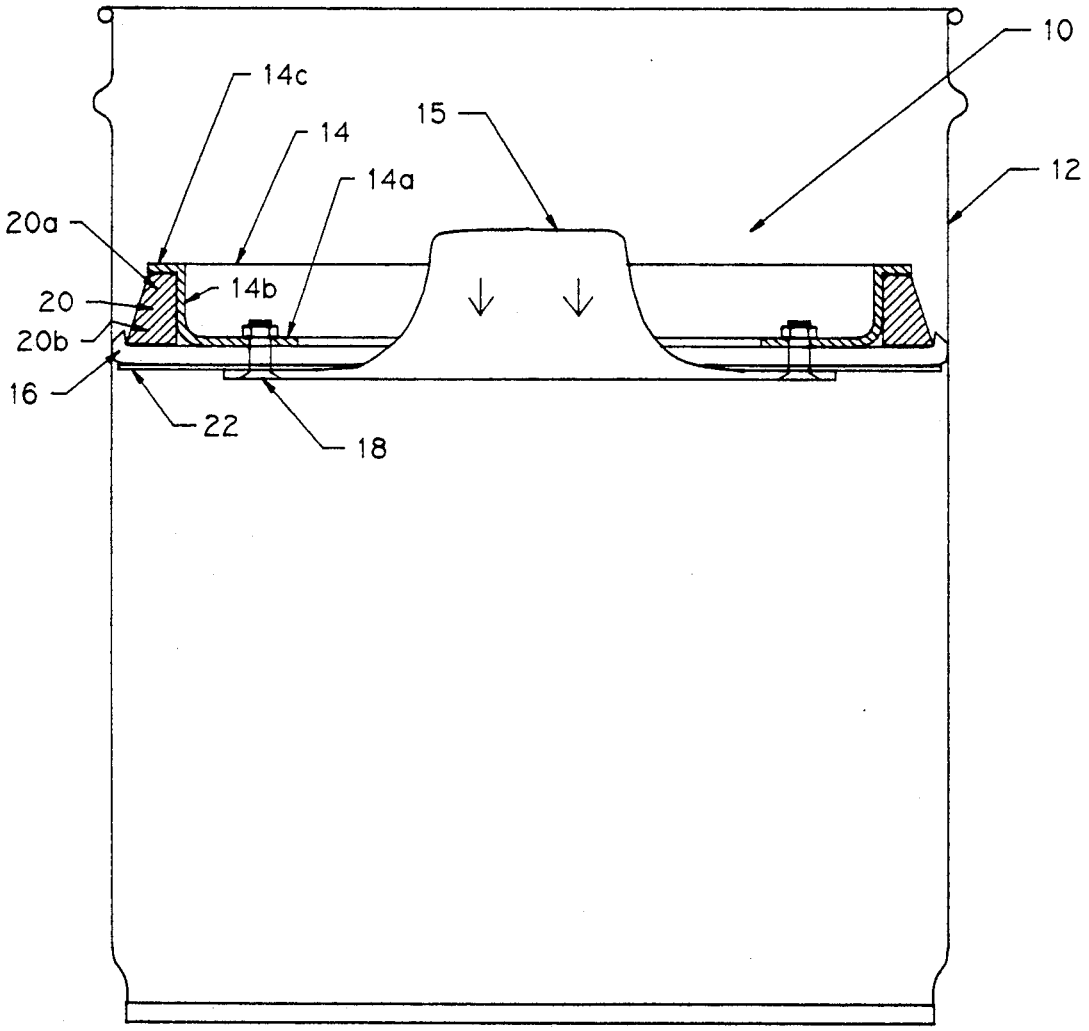
FIG. 1 shows the wiper assembly of the instant invention in a ram application with a straight sided pail.

Referring to FIG. 1, the instant invention, generally designated 10 is shown in a straight sided steel pail 12 in a ram application. Wiper assembly 10 is comprised generally of a wiper plate 14, an inductor plate 15, a main wiper 16, a secondary wiper 22 and a spacer 20. The various components are fastened together via fasteners 18 which may be bolts or the like.

More specifically, wiper plate 14 is comprised of a circular portion 14*a*, a cylindrical portion 14*b* and the lip portion 14*c*. Portion 14*a* has a first diameter at the exterior thereof whereupon it connects to cylindrical portion 14*b* which in turn connects to lip portion 14*c* which terminates at a second diameter.

Spacer 20 has a first end 20*a* and second end 20*b*, first end 20*a*, having a diameter approximately the same as the second diameter while second end 20*b* has a third diameter greater than the second diameter. Spacer 20 is flexible enough for removal without disassembly of said wiper assembly. Spacer 20 may be made from a polyurethane elastomer molding material.

Main wiper 16 has a fourth diameter greater than the third diameter while secondary wiper 22 has a diameter less than that of the fourth diameter. Main wiper 16 may be formed of a reinforced synthetic rubber or Dupont's HYTREL® while secondary wiper 22 is desirably made of polyethylene. The polyethylene secondary wiper 22 acts to protect the main wiper 16 from some of the materials to which it may be subjected.

Figure 2:
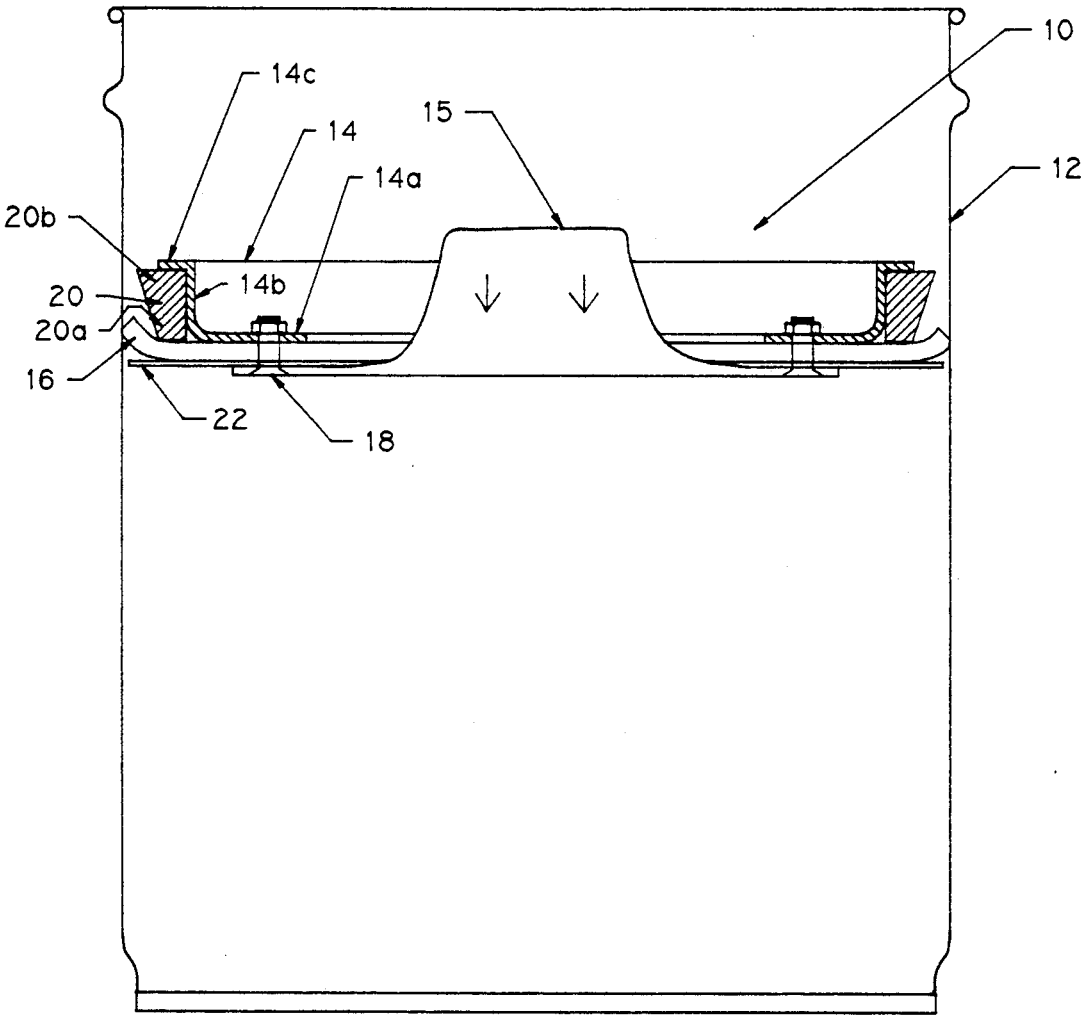
FIG. 2 shows the instant invention in a cart mounted application with a straight sided pail.

FIG. 2 shows the invention 10 in a straight sided steel pail 12 wherein it is used in a cart mounted application. As can be seen, compared to FIG. 1, spacer 20 has been reversed so that second end 20*b* lies adjacent lip 14*c* and it allows main wiper 16 to flex more easily due to the limited downward forces available.

Figure 3:
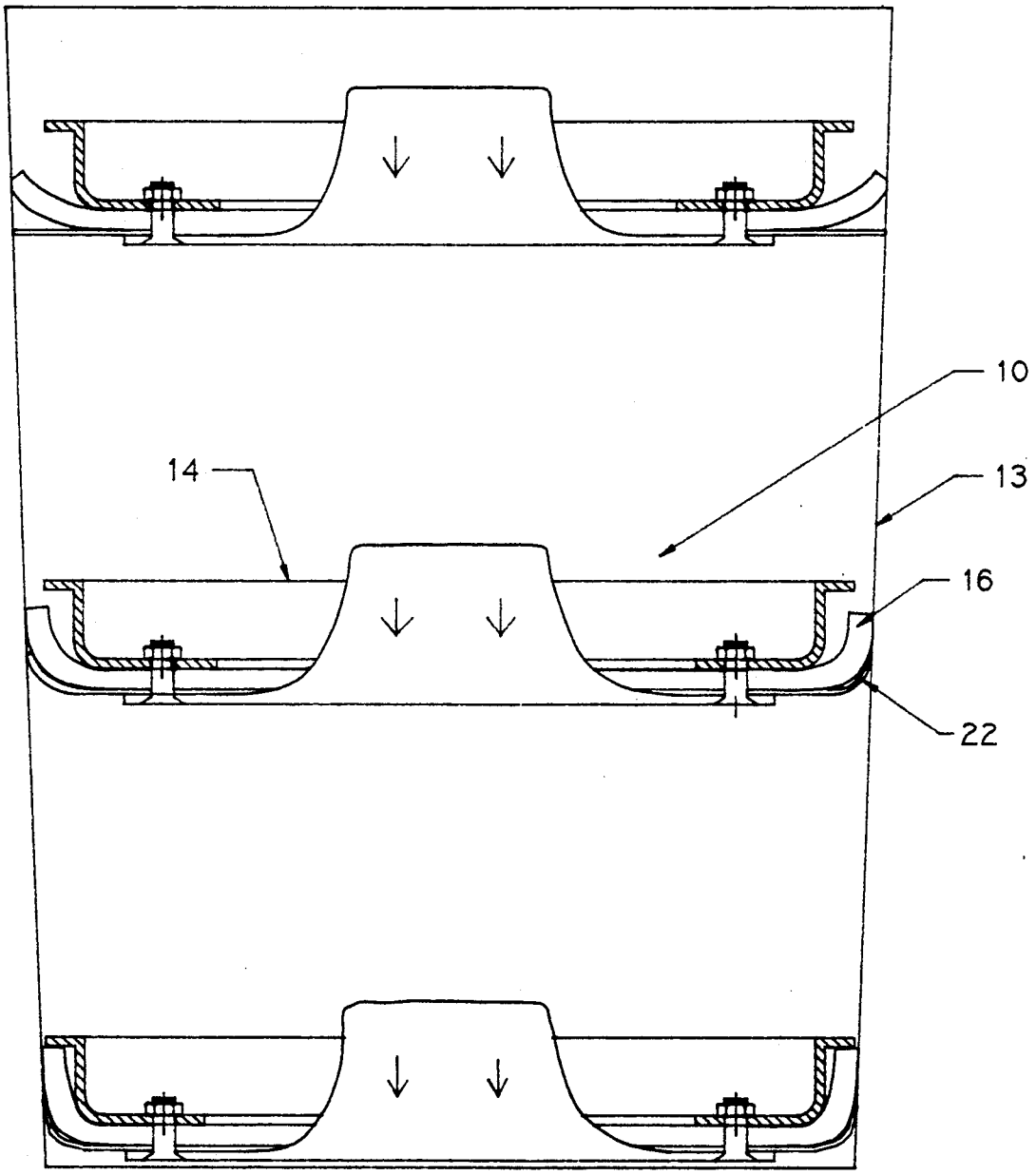
FIG. 3 shows the instant invention utilized in a tapered pail.

Lastly, FIG. 3 shows invention 10 being utilized in a tapered plastic pail 13. It can be seen that spacer 20 is no longer utilized which thereby allows main wiper 16 to flex even more freely as it passes downwardly to the tapered diameter to the point where eventually secondary wiper 22 engages the side of pail 13 and flexes thereby allowing continued effective sealing.

It is contemplated that various changes and modifications may be made to the wiper plate assembly without departing from the spirit and scope of the invention as defined by the following claims.

What is claimed is:

1. A wiper plate assembly for use in a variety of containers, said wiper plate assembly comprising:

a generally circular wiper plate having a bottom and a central aperture for attachment to a pump inlet, said plate comprising:

a central circular portion having a first diameter and containing said aperture;

a cylindrical portion having first and second ends and attached to said first diameter at said first end and extending axially upwardly; and a circular lip portion attached to said cylindrical portion second end and extending radially outwardly to a second diameter;

a hollow generally cylindrical spacer comprising a circumference and first and second ends, said spacer being located around said cylindrical portion with said first spacer end having a diameter being approximately equal to said second diameter and said second spacer end having a third diameter greater than said first spacer end, said spacer being removable and reversible on said cylindrical portion to allow either said spacer end to abut said lip portion; and a flexible main wiper attached to said bottom of said wiper plate, said main wiper having a fourth diameter greater than said third diameter.

2. The wiper plate assembly of claim 1 further comprising a flexible secondary wiper attached to said plate parallel to and below said main wiper and having a diameter less than said fourth diameter.

3. The wiper plate assembly of claim 1 wherein said spacer is flexible enough for removal without disassembly of said wiper assembly.

4. A wiper plate assembly for use in a variety of containers, said wiper plate assembly comprising:

a generally circular wiper plate having a bottom and a central aperture for attachment to a pump inlet, said plate comprising:

a central circular portion having a first diameter and containing said aperture;

a cylindrical portion having first and second ends and attached to said first diameter at said first end and extending axially upwardly; and a circular lip portion attached to said cylindrical portion second end and extending radially outwardly to a second diameter;

a hollow generally cylindrical spacer comprising a circumference and first and second ends, said spacer being located around said cylindrical portion with said first spacer end having a diameter being approximately equal to said second diameter and said second spacer end having a third diameter greater than said first spacer end, said spacer being reversible and removable on said cylindrical portion to allow either said spacer end to abut said lip portion;

a flexible main wiper attached to said bottom of said wiper plate, said main wiper having a fourth diameter greater than said third diameter and a flexible secondary wiper attached to said plate parallel to and below said main wiper and having a diameter less than said fourth diameter.

* * * * *